US008931448B2

(12) United States Patent
Schelter

(10) Patent No.: US 8,931,448 B2
(45) Date of Patent: Jan. 13, 2015

(54) CONSTRUCTED PLASTIC ROTOR WITH INTEGRATED CARTRIDGE AND SPRING SUSPENSION

(71) Applicant: Schaeffler Technologies AG & Co. KG, Herzogenaurach (DE)

(72) Inventor: Stefan Schelter, Dottenheim (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 58 days.

(21) Appl. No.: 13/739,091

(22) Filed: Jan. 11, 2013

(65) Prior Publication Data

US 2013/0186356 A1 Jul. 25, 2013

(30) Foreign Application Priority Data

Jan. 19, 2012 (DE) ..... 10 2012 200 756

(51) Int. Cl.
*F01L 1/34* (2006.01)
*F01L 1/46* (2006.01)
*F01L 1/344* (2006.01)

(52) U.S. Cl.
CPC ..... *F01L 1/46* (2013.01); *F01L 1/3442* (2013.01); *F01L 2001/34469* (2013.01); *F01L 2001/34483* (2013.01); *F01L 2101/00* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS 6,460,496 B2 * 10/2002 Fukuhara et al. ..... 123/90.17
7,318,400 B2 * 1/2008 Lipke et al. ..... 123/90.17
2010/0031906 A1 * 2/2010 Cutt et al.

FOREIGN PATENT DOCUMENTS

DE 102009031934 1/2011

* cited by examiner

*Primary Examiner* — Ching Chang
(74) *Attorney, Agent, or Firm* — Volpe and Koenig, P.C.

(57) ABSTRACT

A cover (4) for covering an axial side of a rotor core (6) that is arranged in a camshaft adjuster (50) and has a passage bore (28) for holding a locking pin (30) with which the rotor core (6) can be secured against rotation relative to a stator (54) of the camshaft adjuster (50). The specified cover includes a base body (8) for axially covering at least one area of the rotor core (6) with the passage bore (28) and a support element (38) that is arranged on the base body (8) for the axial counter support of the locking pin (30).

10 Claims, 5 Drawing Sheets

CONSTRUCTED PLASTIC ROTOR WITH INTEGRATED CARTRIDGE AND SPRING SUSPENSION

INCORPORATION BY REFERENCE

The following documents are incorporated herein by reference as if fully set forth: German Patent Application No.: 102012200756.3, filed Jan. 19, 2012.

FIELD OF THE INVENTION

The invention relates to a cover for covering an axial side of a rotor core that is arranged in a camshaft adjuster, a rotor with the cover, and a camshaft adjuster with the rotor.

BACKGROUND

From DE 10 2009 031 934 A1, a rotor is known consisting of several components for a camshaft adjuster. The rotor has, in detail, a rotor core that is covered with plastic in the axial direction.

In the rotor core, a blind hole is formed in which a locking pin can be guided that secures the rotor against the stator relative to a rotation.

SUMMARY

The object of the invention is to improve the known rotor.

This object is met with a rotor having one or more features of the invention. Preferred improvements are described below and in the claims.

The invention provides that forming a counter support of the locking pin is not in the blind hole of the rotor core, but instead on the cover for the rotor core.

This is based on the idea that the base of the blind hole of the rotor core of the type noted above as a counter support for the locking pin is too expensive, because the locking pin can also be effectively counter supported with lower quality materials like those of the cover.

Therefore, the invention provides a cover for covering an axial side of a rotor core arranged in a camshaft adjuster, wherein the rotor core has a passage bore for holding a locking pin. With the locking pin, the rotor core can be secured against rotation relative to a stator of the camshaft adjuster. The indicated cover comprises a base body for the axial covering of at least one area of the rotor core with the passage bore and a support element arranged on the base body for the axial counter support of the locking pin.

The specified cover allows packaging space to be saved in a camshaft adjuster, because a base that is present in the blind hole in the rotor core of the type noted above and that unnecessary widens the axial thickness of the rotor core can be eliminated. The rotor core can also be produced by the movement of the support element into the cover for economically more favorable basic shapes, because the rotor core can now be produced with a passage bore that can be produced with a significantly wider spectrum of production methods, such as sintering, than a rotor core with a blind hole.

In one refinement of the invention, the specified cover comprises a ventilation channel with an opening in the area of the support element. The ventilation channel allows an air exchange between the passage bore guiding the locking pin and the surroundings of the camshaft adjuster and thus a free movement of the locking pin in the passage bore of the rotor core.

In one special refinement of the invention, the ventilation channel is guided at least partially axially through the base body, which allows particularly quick ventilation with few friction losses of the air at the channel walls.

In an additional refinement of the invention, the ventilation channel is guided out from the opening in the area of the support element along a surface of the base body on which the support element is arranged. In this way, an axial weakening of the ventilation channel can be reduced due to the opening. Here, the ventilation channel can be guided in alternatively already provided axial openings through the base body in an axial opening provided extra for the ventilation channel through the base body or to a radial edge of the support element, in order to open the ventilation channel to the surroundings of the camshaft adjuster.

In another refinement, the specified cover comprises a cartridge that can be inserted concentrically into the passage bore of the rotor core and is held by the support element, wherein the cartridge is provided for engagement in a recess on the locking pin. The cartridge can have a cylindrical, conical, or pyramidal construction and supports the locking element during operation in the passage bore of the rotor core against tilting onto the walls of the passage bore of the rotor core and thus prevents the passage bore of the rotor core and/or the locking pin from being damaged. Through the construction of the cartridge on the support element, this can be formed integrally with the support element and thus with the base body of the specified cover. This can be realized through the injection molding of the cartridge on the support element.

In an alternative refinement of the invention, the specified cover comprises a suspension for a restoring element by which the locking pin can be counter supported on the support element. In this way, all of the essential elements can be produced for the support of the locking pin in the passage bore of the rotor core integrally with the cover.

In another refinement of the invention, the specified cover comprises a recess that is arranged in a different location than the support element and through which material and thus weight can be saved in the construction of the cover.

The invention also provides a rotor for a camshaft adjuster that comprises a rotor core. The rotor core has a hub for holding a camshaft and a passage bore guided through the hub for holding a locking pin with which the rotor core can be secured against rotation relative to a stator of the camshaft adjuster. The specified rotor further comprises a specified cover that is set on the rotor core, wherein the support element axially covers the passage bore of the hub. The cover can be set arbitrarily on the rotor core. Thus, the cover can be initially pre-manufactured and then mounted on the rotor core. In an especially preferred way, the cover is molded on the rotor core, wherein the rotor core itself forms the template form for the production of the cover.

In a preferred refinement, the rotor core comprises the locking pin held in the passage bore of the hub.

The invention also provides a camshaft adjuster that comprises a stator for storing rotational energy from a crankshaft of an internal combustion engine and a specified rotor that is arranged so that it can rotate in the stator for the output of rotational energy from the crankshaft to the camshaft.

BRIEF DESCRIPTION OF THE DRAWINGS

Embodiments of the invention will be explained below with reference to the drawings, in which.

DETAILED DESCRIPTION OF THE PREFERRED EMBODIMENTS

In the figures, the same elements are provided with the same reference symbols and are described only once.

Figure 1:
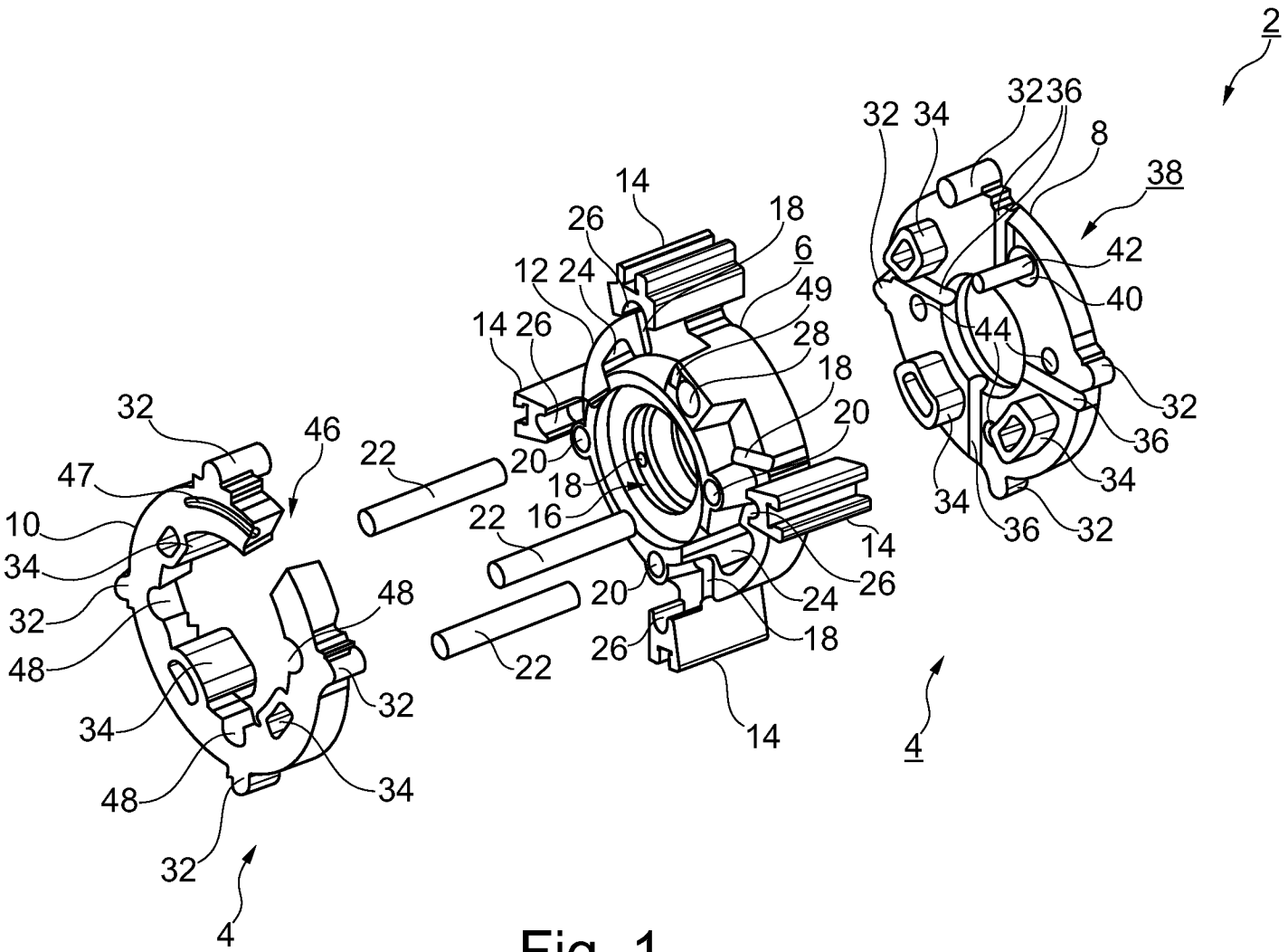
FIG. 1 is an exploded view of a rotor with a cover according to the invention.

FIG. 1 is referenced that shows an exploded view of a rotor 2 with a cover 4 according to the invention.

The rotor 2 is provided for installation in a camshaft adjuster that is still to be described and transmits a rotational energy from a not-shown crankshaft of an internal combustion engine to a not-shown camshaft controlling the internal combustion engine.

In the present construction, the cover 4 is made from plastic and covers a rotor core 6 in the axial direction. It includes a first cover part 8 that covers the rotor core 6 axially from one side and a second cover part 10 that covers the rotor axially from another side lying opposite the first cover part 8 in the axial direction.

The rotor core 6 has a hub 12 on which radial vanes 14 are set. A camshaft receptacle 16 is guided through the hub 12. The camshaft can be held in this receptacle. Ports 18 that are provided in a way that is known to someone skilled in the art for supplying the chambers of the camshaft adjuster with hydraulic fluid extend outward in the radial direction from the camshaft receptacle 16. The ports 18 are lines that are partially open in the axial direction. Furthermore, three pin bores 20 are guided through the rotor core 6. Pins 22 can be inserted in these bores for fixing a restoring spring to be mounted between the rotor 2 and a stator of the camshaft adjuster. In the rotor core 6 there are also material cutouts 24 that are used so that the rotor core has a lighter construction and to save material. Rails 26 are formed underneath the vanes 14. These rails protect the cover parts 8, 10 peripherally against rotation relative to the rotor core 6.

Figure 2:
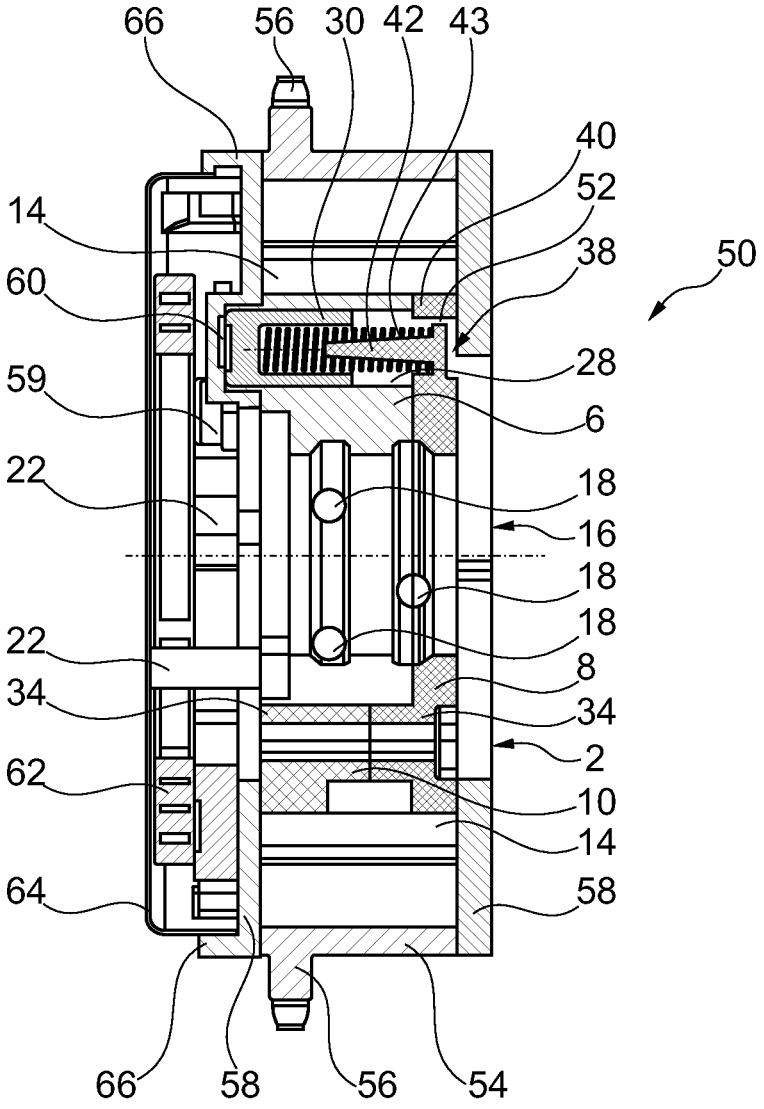
FIG. 2 is a section view of a camshaft adjuster with the rotor from FIG. 1.

A receptacle bore 28 in which a locking pin 30 shown in FIG. 2 can be guided is also guided through the rotor core 6. This locking pin 30 will be discussed in more detail below.

Each of the cover parts 8, 10 has four molded parts 32 that can engage in the rails 26 on the vanes 14 radially in a positive-fit connection. On each cover part 8, 10 one of the molded parts 32 is extended axially in the direction of the rotor core 6 and is thus used as a spacer. Furthermore, each cover part 8, 10 has molded elements 34 that can engage with a positive fit in the material recesses 24. The molded elements 34 meet each other in the material recesses 24 in the axial direction and are thus likewise used as spacers. For saving material, the molded elements can have hollow constructions. Furthermore, each cover part 8, 10 has port elements 36 that axially close the areas of the ports 18 that are guided through the rotor core 6 and that are open.

The first cover part 8 has a support element 38 on which the locking pin 30 can be supported axially. For this purpose, the support element 38 comprises an axial recess 40 that will not be described and from which a cartridge 42 projects in the axial direction. The first cover part 8 furthermore has receptacle bores 44 in which the pins 22 can be supported for the spring suspension.

The second cover part 10 has an open segment 46 between which the receptacle bore 28 of the rotor core 6 can be inserted. In the open segment 46, a supply channel 47 is guided that can be connected, for example, to one of the chambers of the camshaft adjuster formed between the vanes 14, in order to fill the receptacle bore 28 with hydraulic fluid and to control the position of the locking pin 30 based on the hydraulic fluid. Accordingly, the receptacle opening 28 in the area of the supply channel 47 can have an axial notch 49. Furthermore, the second cover part 10 has guides 48 that guide the pins 22 for the spring suspension radially onto the axial side of the second cover part 10 opposite the rotor core 6.

FIG. 2 is referenced that shows a section view of a camshaft adjuster 50 with the rotor 2 from FIG. 1.

As can be seen from FIG. 2, the locking pin 30 has a recess in which the cartridge 42 is inserted. Here, the locking pin 30 is supported by a spring 43 in the axial recess 40. The axial recess 40 of the support element 38 has a ventilation opening 52 through which air can be discharged. This air can collect in a space that is limited by the locking pin 30, the receptacle bore 28, and the first cover part 8.

The rotor 2 is held in a stator 54 that has, on its periphery, teeth 56 in which a not-shown chain can engage for the transmission of force between the crankshaft on the internal combustion engine and the stator 54. The two axial cover surfaces of the stator 54 are each closed by a cover 58 that is fixed on the stator 54 by screws 59.

The cover 58 on the axial side of the second cover part 10 has an axial recess 60 in which the locking pin 30 can engage. In the rest state of the camshaft adjuster 50, the locking pin 30 prevents the rotor 6 from being able to rotate against the stator 54. If oil is fed to the camshaft adjuster in a way that is known to those skilled in the art for moving the rotor 6 relative to the stator 54, a part of this oil is pumped via the supply channel 47 into the axial recess 60, so that the oil presses the locking pin 30 axially into the receptacle bore 28 and rotation of the rotor 6 opposite the stator 54 is possible. Axial recess 60 can be provided at several peripheral positions on the corresponding cover 58, in order to be able to secure the rotor 6 in multiple positions against rotation relative to the stator 54.

A spiral spring 62 is tensioned between one of the pins 22 on the rotor 6 and a suspension not shown further on the stator 54, in order to overcome a drag moment of the camshaft.

The spiral spring 62 is covered by a spring cover 64 that engages axially in a collar 66 on the corresponding cover 58 on which the spiral spring 62 is arranged.

Figure 3:
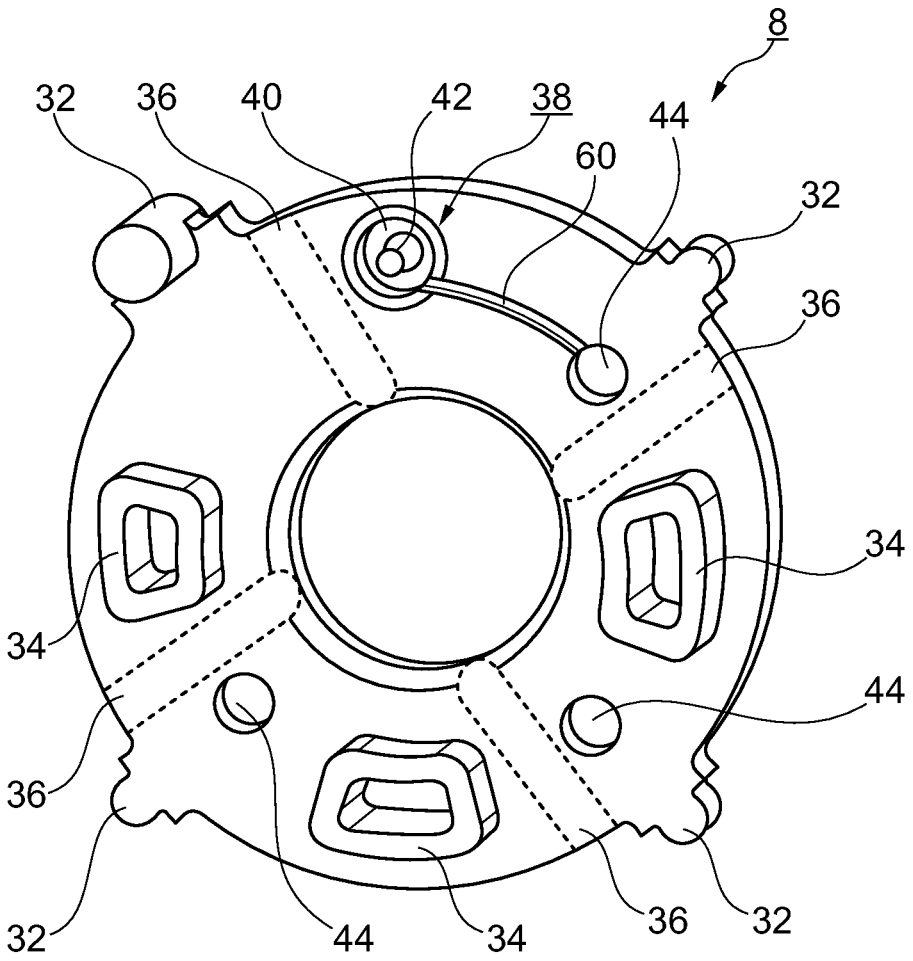
FIG. 3 is a perspective view of an alternative part of the cover of the rotor of FIG. 1.

FIG. 3 is referenced that shows a perspective view of an alternative first cover part 8 of the rotor 6 of FIG. 1.

As is to be seen from FIG. 3, instead of or as an alternative to the ventilation opening 52, a ventilation channel 60 is provided that enables the ventilation of the space between the cover part 8, the receptacle opening 28, and the corresponding cover 58 via the receptacle bores 44 for the pins 22 for spring suspension.

Figure 4:
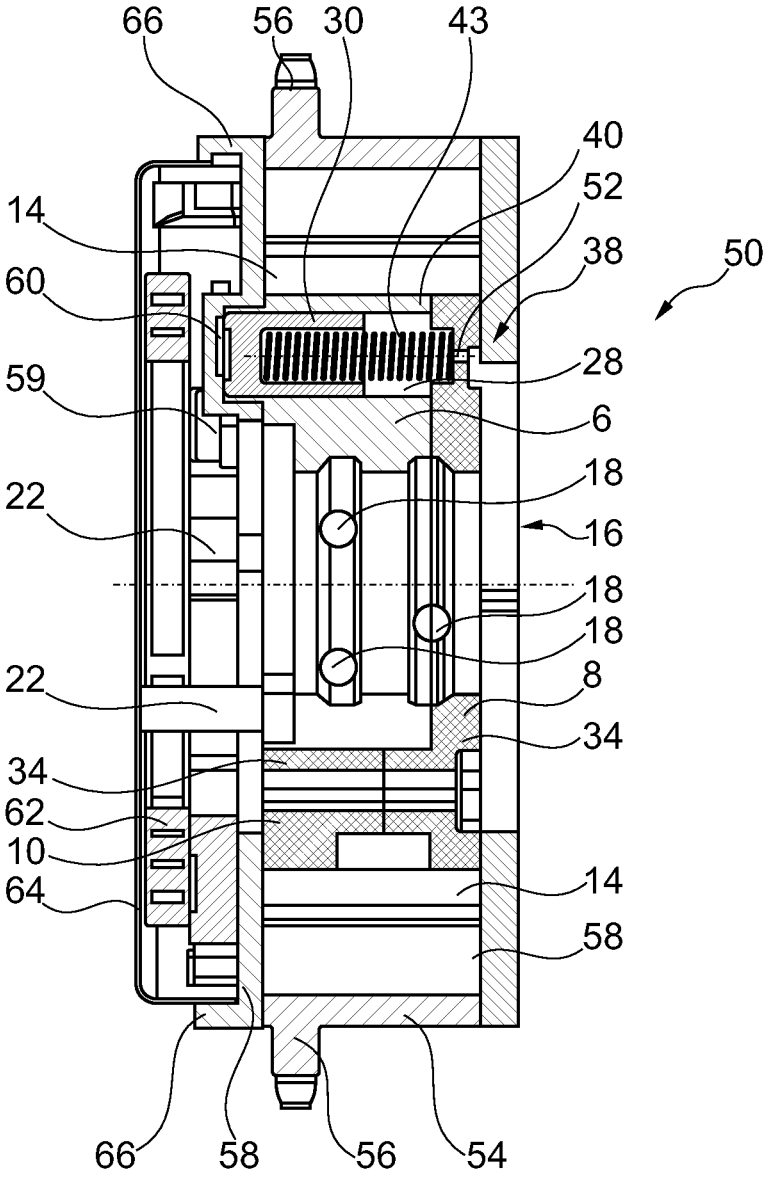
FIG. 4 is a section view of a camshaft adjuster with another rotor.

FIG. 4 is referenced that shows a section view of a camshaft adjuster 50 with an alternative rotor 6.

In the rotor 6 of FIG. 4, the first cover part 8 has no cartridge 42 on the support element 38, wherein the ventilation opening 52 can be guided centrally through the first cover part 8.

Figure 5:
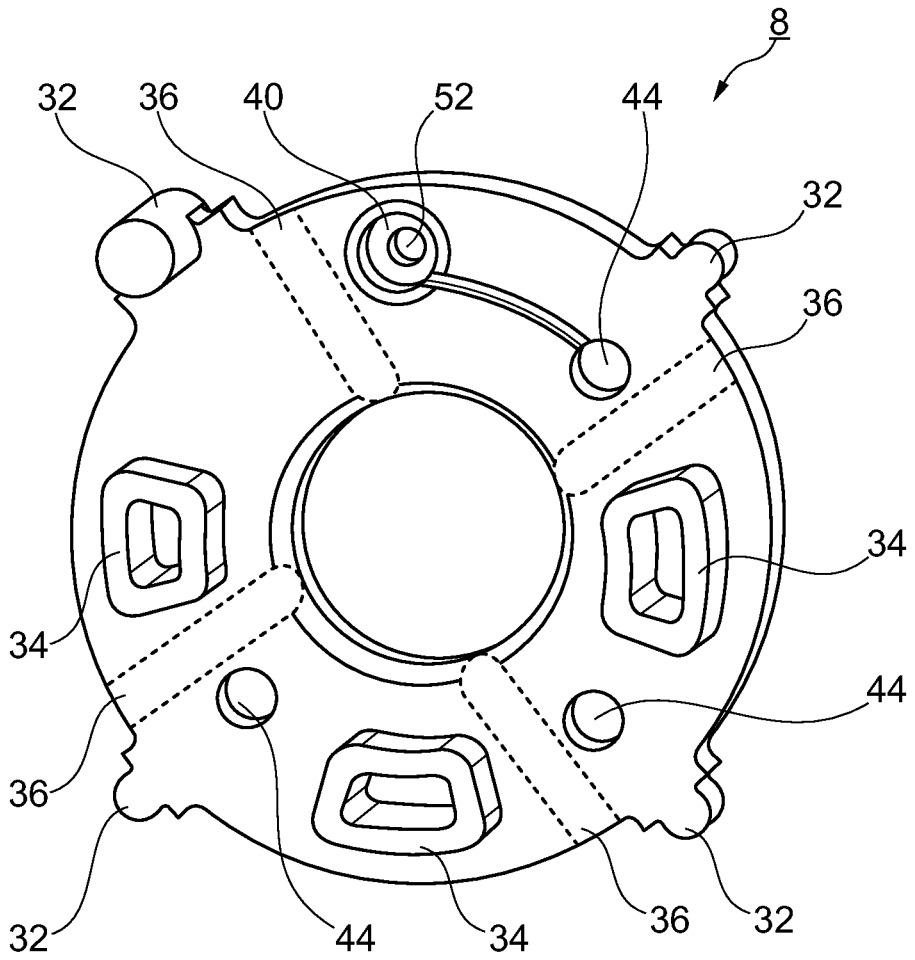
FIG. 5 is a perspective view of a part of the cover of the rotor of FIG. 4.

A corresponding first cover part 8 is shown in FIG. 5 that shows the first cover part 8 in a perspective view.

LIST OF REFERENCE NUMBERS

2 Rotor
4 Cover

6 Rotor core
8 Cover part
10 Cover part
12 Hub
14 Vane
16 Camshaft receptacle
18 Port
20 Pin bore
22 Pin
24 Material cutout
26 Rail
28 Receptacle bore
30 Locking pin
32 Molded part
34 Molded element
36 Port element
38 Support element
40 Recess
42 Cartridge
43 Spring
44 Receptacle bore
46 Segment
47 Supply channel
48 Guide
49 Notch
50 Camshaft adjuster
52 Ventilation bore
54 Stator
56 Teeth
58 Cover
60 Recess
62 Spiral spring
64 Spring cover

The invention claimed is:

1. A cover for covering an axial side of a rotor core that is arranged in a camshaft adjuster, the rotor core includes a passage bore for holding a locking pin with which the rotor core can be secured against rotation relative to a stator of the camshaft adjuster, the cover comprising a base body for axial covering of at least one area of the rotor core with the passage bore, and a support element is arranged on the base body and axially extends from the base body for an axial counter support of the locking pin.

2. The cover according to claim 1, comprising a ventilation channel with an opening in an area of the support element.

3. The cover according to claim 2, wherein the ventilation channel is guided at least partially in the axial direction by the base body.

4. The cover according to claim 2, wherein the ventilation channel is guided out from an opening in an area of the support element along a surface of the base body on which the support element is arranged.

5. The cover according to claim 1, further comprising a cartridge that can be inserted concentrically in the passage bore and is held by the support element, the cartridge is provided for engagement in a recess on the locking pin.

6. The cover according to claim 1, further comprising a suspension for a restoring element by which the locking pin is counter supported on the support element.

7. The cover according to claim 1, further comprising a recess located in the base body that is arranged in a different location than the support element.

8. A rotor for a camshaft adjuster comprising a rotor core that has a hub for holding a camshaft and a passage bore guided through the hub for holding a locking pin with which the rotor core can be secured against rotation relative to a stator of the camshaft adjuster, and a cover according to claim 1 that is set axially on the rotor core, and the support element covers the passage bore of the hub in the axial direction.

9. The rotor according to claim 8, comprising the locking pin held in the passage bore of the hub.

10. A camshaft adjuster comprising a stator for storing rotational energy from a crankshaft of an internal combustion engine and a rotor that is arranged so that it can rotate in the stator and that is constructed according to claim 8 for output of the rotational energy from the crankshaft to the camshaft.

* * * * *